US010080408B1

(12) United States Patent
Wood

(10) Patent No.: US 10,080,408 B1
(45) Date of Patent: Sep. 25, 2018

(54) CELL PHONE CASE AND WALLET

(71) Applicant: Joshua Wood, Riverside, CA (US)

(72) Inventor: Joshua Wood, Riverside, CA (US)

( * ) Notice: Subject to any disclaimer, the term of this patent is extended or adjusted under 35 U.S.C. 154(b) by 253 days.

(21) Appl. No.: 15/201,911

(22) Filed: Jul. 5, 2016

(51) Int. Cl.
*A45C 1/06* (2006.01)
*A45C 11/00* (2006.01)
*A45C 13/00* (2006.01)

(52) U.S. Cl.
CPC ..... *A45C 1/06* (2013.01); *A45C 11/00* (2013.01); *A45C 13/007* (2013.01); *A45C 2001/065* (2013.01); *A45C 2011/002* (2013.01)

(58) Field of Classification Search
CPC A45C 1/06; A45C 15/00; A45C 11/18; A45C 11/182; A45C 13/36; A45C 11/00
USPC ..... 150/131–147; 206/478; 224/250, 223; 446/487; D3/247
See application file for complete search history.

(56) References Cited

U.S. PATENT DOCUMENTS 1,991,306 A * 2/1935 Woolsey ..... A45C 13/02 132/312
D264,022 S * 4/1982 Wayman ..... D3/247
4,940,068 A * 7/1990 Pokorny ..... A45C 1/06 150/132
5,110,232 A * 5/1992 Jermann ..... B42F 7/00 281/18
5,370,288 A * 12/1994 Field ..... A45C 13/02 211/60.1
7,204,398 B1 4/2007 Smith, Sr.
D543,023 S 5/2007 Jin Han
D602,689 S 10/2009 Hewill
D619,356 S 7/2010 Hillman
D639,552 S 6/2011 Du
D703,949 S 5/2014 Chappell
8,718,725 B2 5/2014 Kemppinen
8,923,938 B2 12/2014 Elizabeth
9,086,845 B2 * 7/2015 Chen ..... G06F 1/1626
D758,724 S * 6/2016 Guest ..... D3/247
9,861,078 B1 * 1/2018 Mantelli ..... A01K 27/008
2001/0027834 A1 10/2001 Southwick
2011/0077061 A1 3/2011 Danze
2013/0276943 A1 * 10/2013 Minn ..... A45C 1/06 150/137
2015/0083289 A1 * 3/2015 Johnson ..... A45C 1/06 150/144
2017/0055654 A1 * 3/2017 King ..... A45C 1/06
2017/0119115 A1 * 5/2017 King ..... A45C 1/06

* cited by examiner

*Primary Examiner* — Fenn C Mathew
*Assistant Examiner* — Cynthia Collado

(57) ABSTRACT

The cell phone case and wallet is a small folding case that is adapted for use with a personal data device. The cell phone case and wallet combines the functions of a wallet and a personal data device case into a single personal accessory. The cell phone case and wallet can be folded such that the personal data device contained within the cell phone case and wallet is accessible for use or can be enclosed within the cell phone case and wallet. The cell phone case and wallet is further capable of containing and storing domestic articles including, but not limited to, personal identification, a plurality of credit cards, cash, and personal items for ready access. The cell phone case and wallet comprises a plurality of panels and a plurality of straps.

14 Claims, 9 Drawing Sheets

CELL PHONE CASE AND WALLET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transmission systems, more specifically, an arrangement for carrying and protecting transceivers.

SUMMARY OF INVENTION

The cell phone case and wallet is a small folding case that is adapted for use with a personal data device. The cell phone case and wallet combines the functions of a wallet and a personal data device case into a single personal accessory. The cell phone case and wallet can be folded such that the personal data device contained within the cell phone case and wallet is accessible for use or can be enclosed within the cell phone case and wallet. The cell phone case and wallet is further capable of containing and storing domestic articles including, but not limited to, personal identification, a plurality of credit cards, cash, and personal items for ready access.

These together with additional objects, features and advantages of the cell phone case and wallet will be readily apparent to those of ordinary skill in the art upon reading the following detailed description of the presently preferred, but nonetheless illustrative, embodiments when taken in conjunction with the accompanying drawings.

In this respect, before explaining the current embodiments of the cell phone case and wallet in detail, it is to be understood that the cell phone case and wallet is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the cell phone case and wallet.

It is therefore important that the claims be regarded as including such equivalent construction insofar as they do not depart from the spirit and scope of the cell phone case and wallet. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
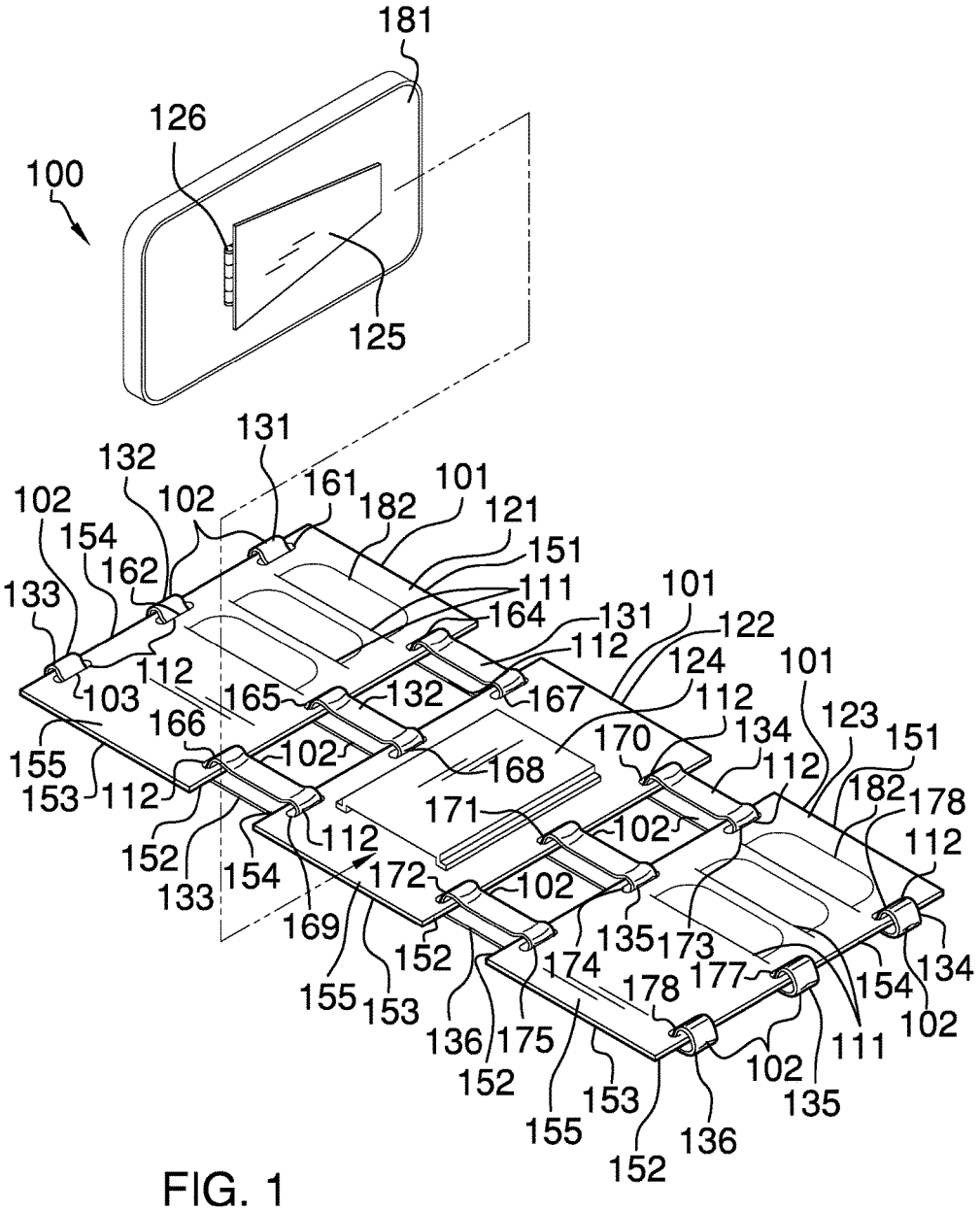
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 10.

The cell phone case and wallet 100 (hereinafter invention) comprises a plurality of panels 101 and a plurality of straps 102. The invention 100 is a small folding case that is adapted for use with a personal data device 181. The invention 100 combines the functions of a wallet and a personal data device case into a single personal accessory. The invention 100 can be folded such that the personal data device 181 contained within the invention 100 is accessible for use or can be enclosed within the invention 100. The invention 100 is further capable of containing and storing domestic articles including, but not limited to, personal identification, a plurality of credit cards 182, cash, and personal items for ready access.

Each of the plurality of panels 101 is a plate that is made of a solid and stiff but not inflexible material. In the first potential embodiment of the disclosure, each of the plurality of panels 101 is a rectangular strip in form and shape. Each of the plurality of panels 101 is further defined with a first surface 155 and a second surface 156. In the first potential embodiment of the disclosure, each of the plurality of panels 101 is further defined with a first edge 151, a second edge 152, a third edge 153, and a fourth edge 154. Each of the plurality of panels 101 further comprises a plurality of pockets 111. Each of the plurality of pockets 111 is sized to receive a credit card 182 or similarly sized item. Each of the plurality of panels 101 further comprises a plurality of holes 112. Each of the plurality of holes is sized to receive a strap selected from the plurality of straps 102. Each of the plurality of holes 112 is located along the second edge 152 and the fourth edge 154 of the selected panel. Each strap selected from the plurality of straps 102 is threaded through the plurality of holes 112 in order to attach the selected panel to each of the remaining panels contained in the plurality of panels 101.

The plurality of panels 101 further comprises a first panel 121, a second panel 122, and a third panel 123. The first panel 121 further comprises a first plurality of holes 113. The second panel 122 further comprises a second plurality of holes 114. The third panel 123 further comprises a third plurality of holes 115. The first plurality of holes 113 further comprises a first hole 161, a second hole 162, a third hole 163, a fourth hole 164, a fifth hole 165, and a sixth hole 166. The second plurality of holes 114 further comprises a seventh hole 167, an eighth hole 168, a ninth hole 169, a tenth hole 170, an eleventh hole 171, and a twelfth hole 172. The third plurality of holes 115 further comprises a thirteenth hole 173, a fourteenth hole 174, a fifteenth hole 175, a sixteenth hole 176, a seventeenth hole 177, and an eighteenth hole 178.

The personal data device 181 is attached to the second panel 122 using a rail 124 and a bracket 125. The bracket 125 is a clip that is attached to the personal data device 181. The bracket 125 may be attached to the personal data device 181 via a spring-loaded hinge 126. The spring-loaded hinge 126 enables the bracket 125 to rotate outwardly with respect to the personal data device 181 in order to support said personal data device on a supporting surface 500 (see FIG. 10).

The rail 124 is a raised track that is attached to the first surface 155 of the second panel 122. The rail 124 is designed and installed such that the bracket 125 will slip over the rail 124 and slide easily along the rail 124. As shown most clearly in FIG. 8, this sliding motion allows the position of the personal data device 181 to change relative to the plurality of panels 101 such that the camera 183 of the personal data device 181 can take photographs while the personal data device 181 is contained in the invention 100. In the first potential embodiment of the disclosure, the bracket 125 is a strip of metal or plastic that is attached at one end to the personal data device 181 in the manner of a cantilever that runs parallel to the personal data device 181. The rail 124 is a strip of metal that is raised from the second panel 122 such that the bracket 125 can be slipped between the rail 124 and the first surface 155 of the second panel 122.

Each of the plurality of straps 102 is a band that is initially formed from a strip of material. Suitable materials include, but are not limited to, a webbing or a strip cut from a sheeting material. Each end of the plurality of straps 102 is threaded through holes selected from the first panel 121, the second panel 122, and the third panel 123 in order to interconnect the plurality of panels 101 to each other. Any selected end of each selected strap is attached to a remaining end of the selected strap using a seam in order to form the strap selected from the plurality of straps 102. When the selected material is a webbing, a sewn seam is used as the seam. When a strip cut from a sheeting material is used, the seam is formed by heat fusing the strip cut from the sheeting material.

In alternate potential embodiments of the disclosure, each of the plurality of straps 102 is an elastic band. Suitable materials to form the elastic band include, but are not limited to, an elastic webbing or a strip cut from an elastic sheeting material.

The plurality of straps 102 further comprises a first strap 131, a second strap 132, a third strap 133, a fourth strap 134, a fifth strap 135, and a sixth strap 136. The first strap 131 is further defined with a first end 191 and a second end 192. The second strap 132 is further defined with a third end 193 and a fourth end 194. The third strap 133 is further defined with a fifth end 195 and a sixth end 196. The fourth strap 134 is further defined with a seventh end 197 and an eighth end 198. The fifth strap 135 is further defined with a ninth end 199 and a tenth end 200. The sixth strap 136 is further defined with an eleventh end 201 and a twelfth end 202.

Figure 3:
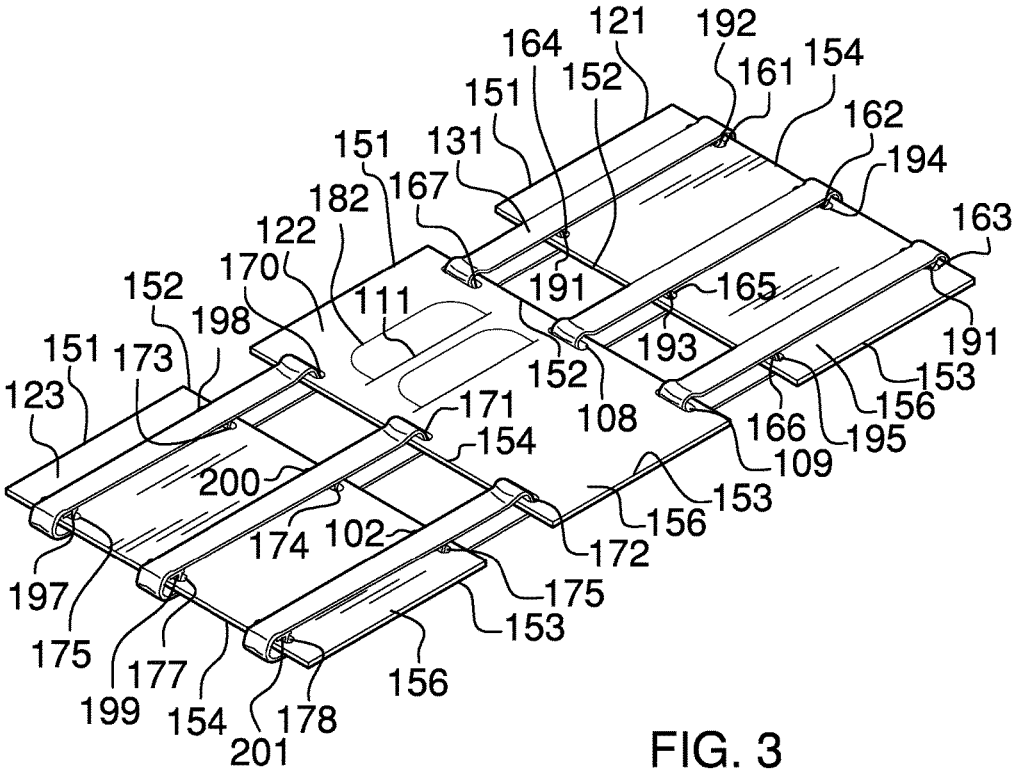
FIG. 3 is a bottom perspective view of an embodiment of the disclosure.

As shown most clearly in FIG. 3, the first potential embodiment of the disclosure is assembled as follows.

The first strap 131 is routed through the seventh hole 167 from the second surface 156 of the second panel 122 to the first surface 155 of the second panel 122. The first strap 131 is then routed through the fourth hole 164 from the first surface 155 of the first panel 121 through to the second surface 156 of the first panel 121. The first strap 131 is then routed through the first hole 161 from the second surface 156 of the first panel 121 to the first surface 155 of the first panel 121. The first strap 131 is then folded over the fourth edge 154 of the first panel 121. The first end 191 and the second end 192 of the first strap 131 are joined with a first seam 141.

The second strap 132 is routed through the eighth hole 168 from the second surface 156 of the second panel 122 to the first surface 155 of the second panel 122. The second strap 132 is then routed through the fifth hole 165 from the first surface 155 of the first panel 121 through to the second surface 156 of the first panel 121. The second strap 132 is then routed through the second hole 162 from the second surface 156 of the first panel 121 to the first surface 155 of the first panel 121. The second strap 132 is then folded over the fourth edge 154 of the first panel 121. The third end 193 and the fourth end 194 of the second strap 132 are joined with a second seam 142.

The third strap 133 is routed through the ninth hole 169 from the second surface 156 of the second panel 122 to the first surface 155 of the second panel 122. The third strap 133 is then routed through the sixth hole 166 from the first surface of the first panel 121 through to the second surface 156 of the first panel 121. The third strap 133 is then routed through the third hole 163 from the second surface 156 of the first panel 121 to the first surface 155 of the first panel 121. The third strap 133 is then folded over the fourth edge 154 of the first panel 121. The fifth end 195 and the sixth end 196 of the third strap 133 are joined with a third seam 143.

The fourth strap 134 is routed through the tenth hole 170 from the second surface 156 of the second panel 122 to the first surface 155 of the second panel 122. The fourth strap 134 is then routed through the thirteenth hole 173 from the first surface 155 of the third panel 123 through to the second surface 156 of the third panel 123. The fourth strap 134 is then routed through the sixteenth hole 176 from the second surface 156 of the third panel 123 to the first surface 155 of the third panel 123. The fourth strap 134 is then folded over the fourth edge 154 of the third panel 123. The seventh end 197 and the eighth end 198 of the fourth strap 134 are joined with a fourth seam 144.

The fifth strap 135 is routed through the eleventh hole 171 from the second surface 156 of the second panel 122 to the first surface 155 of the second panel 122. The fifth strap 135 is then routed through the fourteenth hole 174 from the first surface 155 of the third panel 123 through to the second surface 156 of the third panel 123. The fifth strap 135 is then routed through the seventeenth hole 177 from the second surface 156 of the third panel 123 to the first surface 155 of the third panel 123. The fifth strap 135 is then folded over the fourth edge of the third panel 123. The ninth end 199 and the tenth end 200 of fifth strap 135 are joined with a fifth seam 145.

The sixth strap 136 is routed through the twelfth hole 172 from the second surface 156 of the second panel 122 to the first surface 155 of the second panel 122. The sixth strap 136 is then routed through the fifteenth hole 175 from the first surface 155 of the third panel 123 through to the second surface 156 of the third panel 123. The sixth strap 136 is then routed through the eighteenth hole 178 from the second surface 156 of the third panel 123 to the first surface 155 of the third panel 123. The sixth strap 136 is then folded over the fourth edge 154 of the third panel 123. The eleventh end 201 and the twelfth end 202 of sixth strap 136 are joined with a sixth seam 146.

Figure 7:
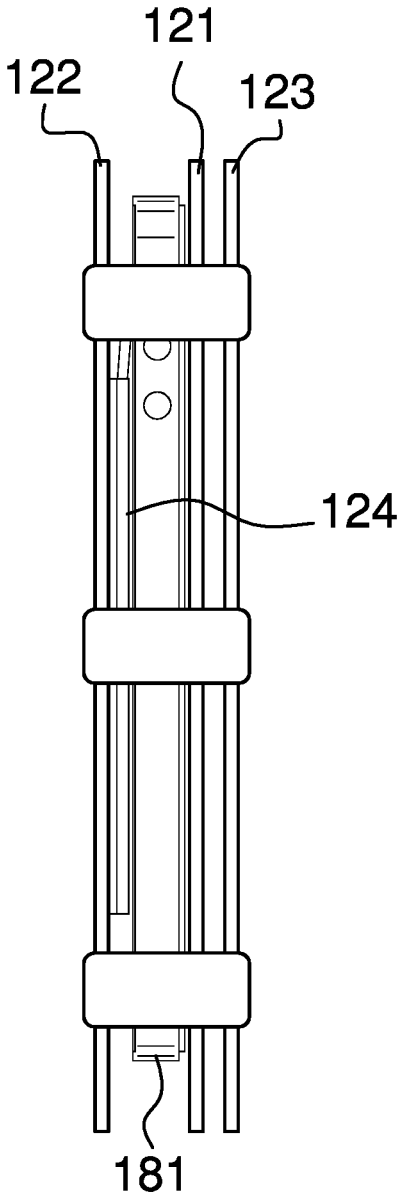
FIG. 7 is an in use view of an embodiment of the disclosure.
Figure 8:
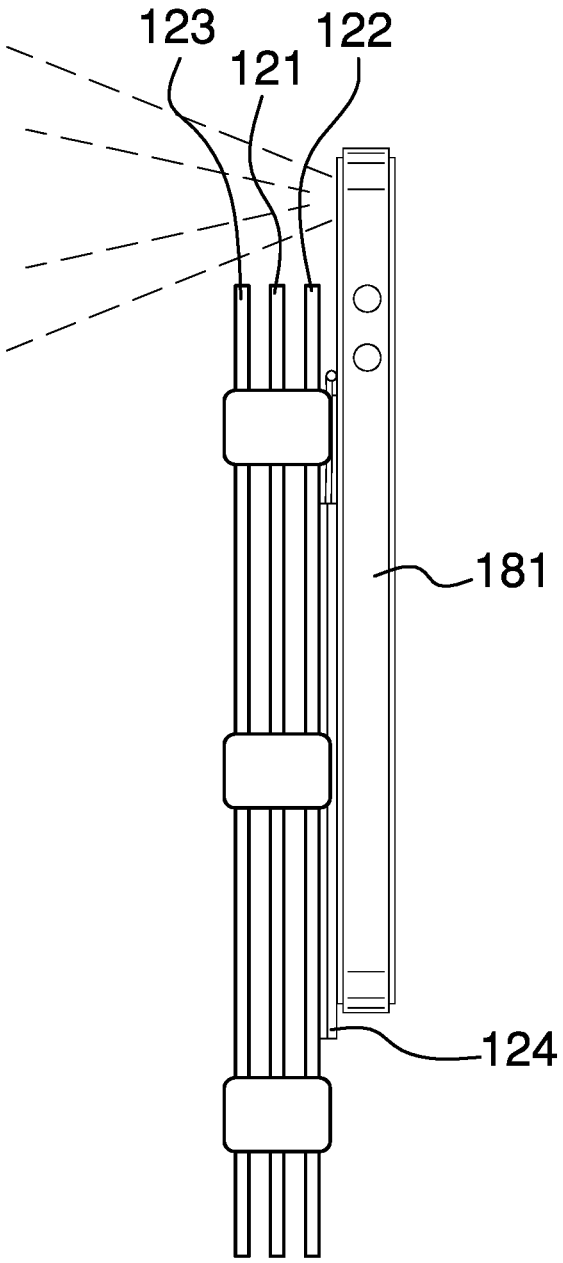
FIG. 8 is an in use view of an embodiment of the disclosure.
Figure 9:
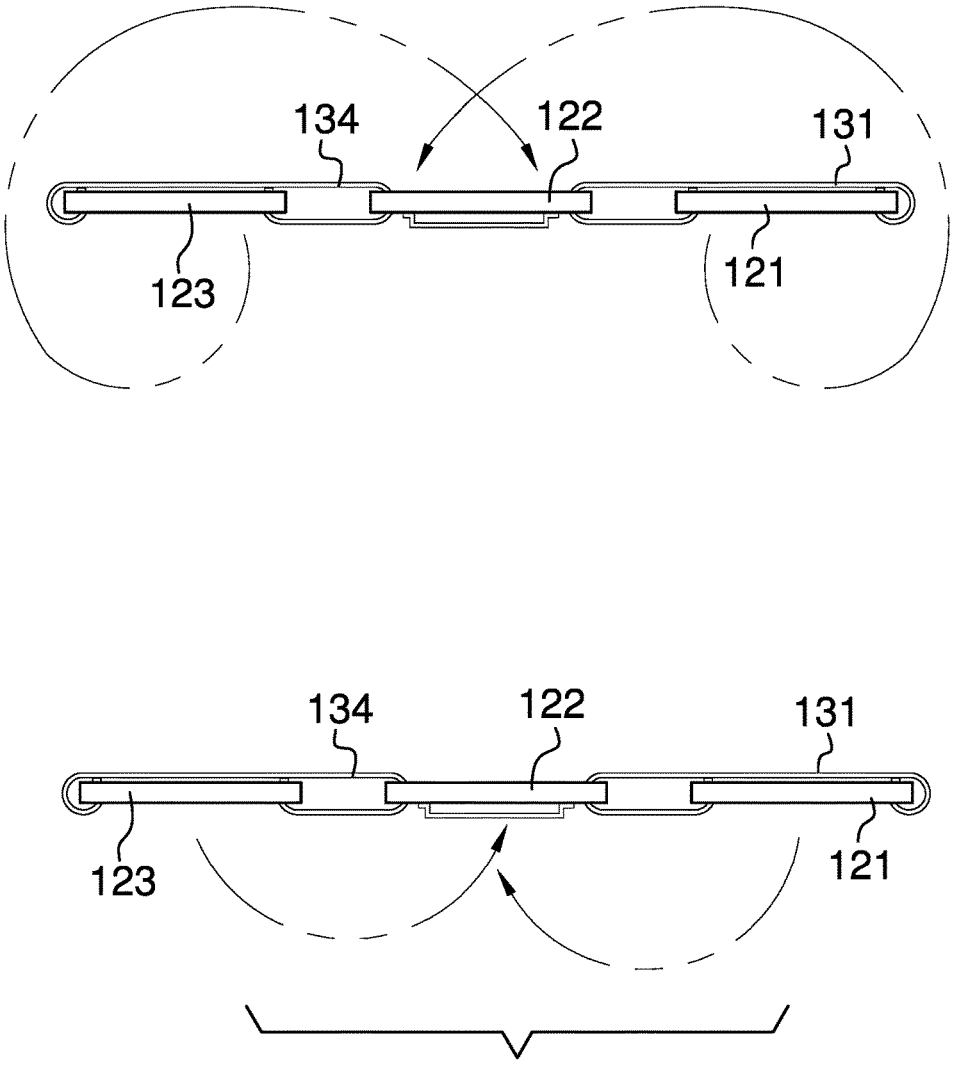
FIG. 9 is a side view of an embodiment of the disclosure.
Figure 10:
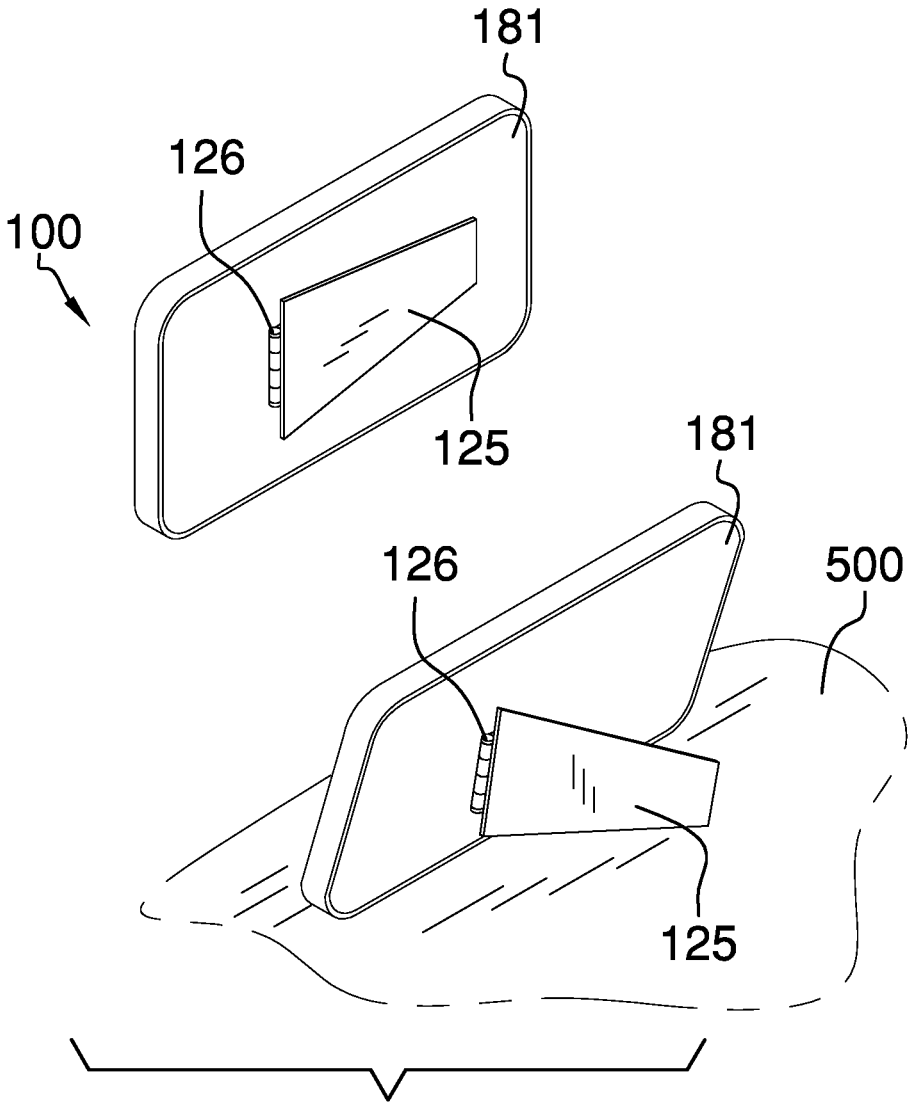
FIG. 10 is a perspective view of an embodiment of the disclosure in use.

To order to use the invention 100, the bracket 125 is attached to the personal data device 181 and the bracket 125 with the personal data device 181 is inserted into the space between the first surface 155 of the second panel 122 and the rail 124. As shown most clearly in FIGS. 7, 8, and 9, the first panel 121 and the third panel 123 are folded towards the second panel 122 and the personal data device 181. For example, as shown in FIG. 7, the first panel 121 and the third panel 123 can be folded on top of the personal data device 181 and the first surface 155 of the second panel 122 to guard the privacy of the personal data device 181. Alternatively, as shown in FIG. 8, the first panel 121 and the third panel 123 can be folded on top of the second surface 156 of the second panel 122 thereby providing access to the personal data device 181 while it is attached to the invention 100.

Figure 2:
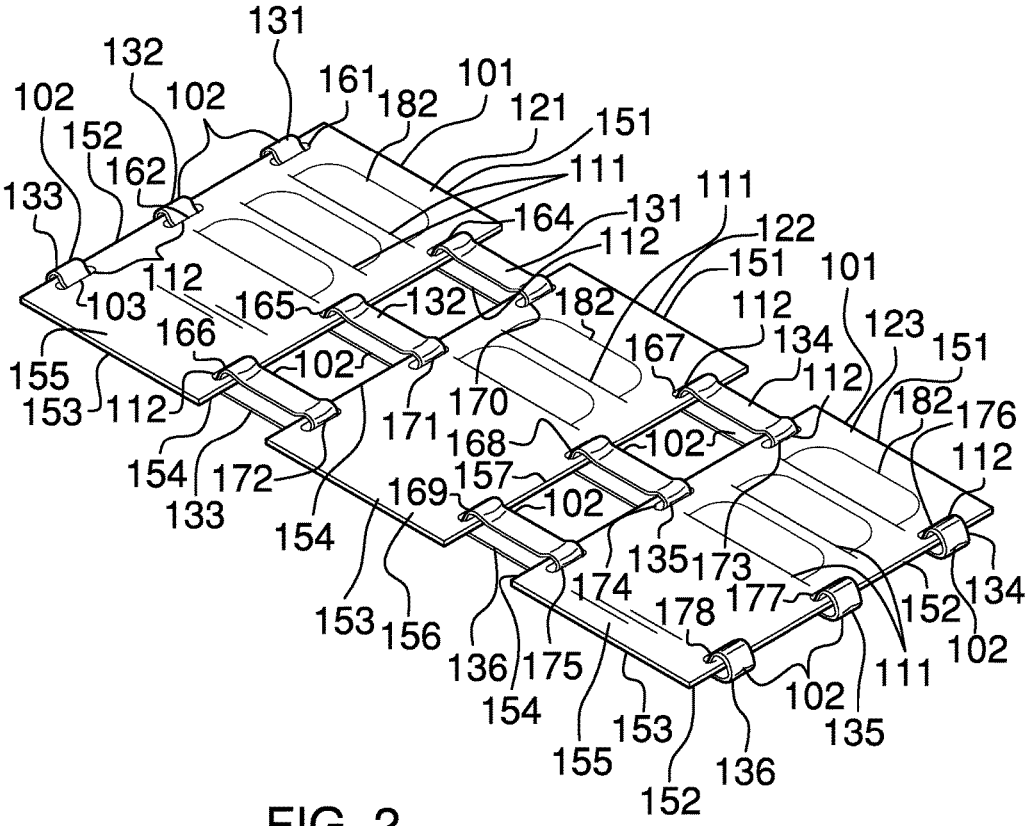
FIG. 2 is a perspective view of an alternative embodiment of the disclosure.
Figure 4:
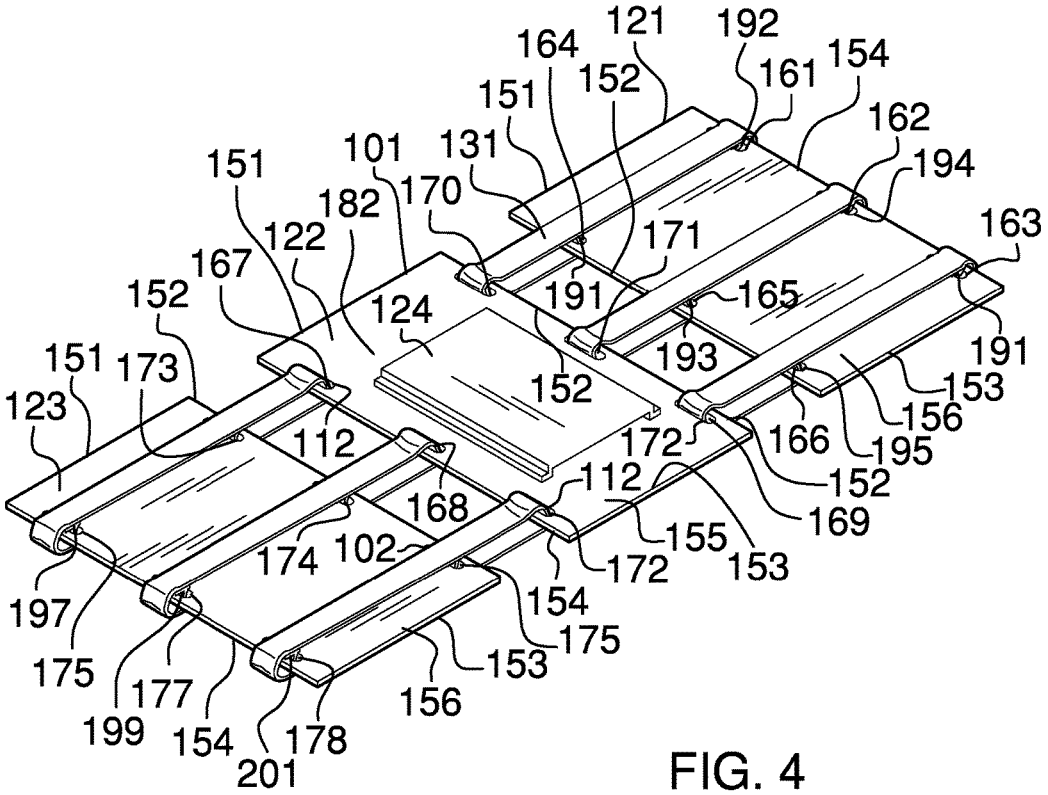
FIG. 4 is a bottom perspective view of an alternative embodiment of the disclosure.
Figure 5:
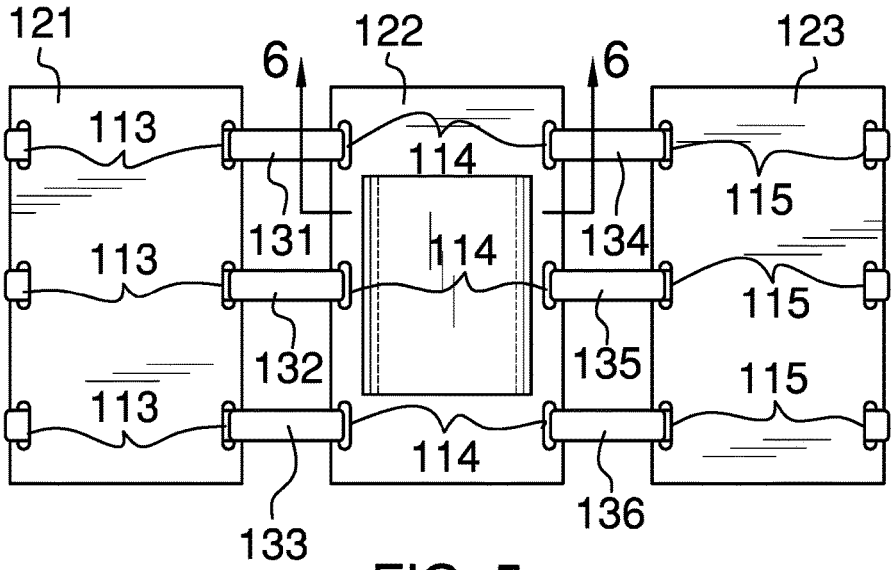
FIG. 5 is a top view of an embodiment of the disclosure.
Figure 6:
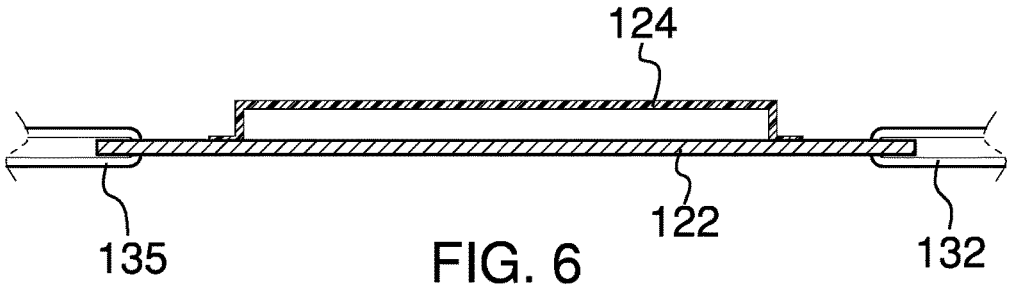
FIG. 6 is a cross-sectional view of an embodiment of the disclosure across 6-6 as shown on FIG. 5.

It shall be noted that FIG. 2 represents an alternative embodiment when compared to the invention 100 of FIG. 1. Namely, the rail 124 is exchanged for the plurality of pockets 111. Moreover, FIG. 4 is an alternative embodiment when compared to the invention 100 of FIG. 3. Namely, the plurality of pockets 111 are exchanged for the rail 124.

The following definitions were used in this disclosure:

Band: As used in this disclosure, a band is a flat loop of material.

Cantilever: As used in this disclosure, a cantilever is a beam or other structure that projects away from an object and is supported on only one end.

Domestic Article: As used in this disclosure, a domestic article is an item or object: 1) that is commonly found within a household; or, 2) that is commonly carried by a person. Examples of domestic articles include, but are not limited to, keys and key fobs, personal data devices, glasses, remote controls, or personal storage items such as purses, briefcases, wallets, or cases.

Elastic: As used in this disclosure, an elastic is a material or object that deforms when a force is applied to it and that is able to return to its original shape after the force is removed. A material that exhibits these qualities is also referred to as an elastomeric material.

Elastic band: As used in this disclosure, an elastic band is a loop of textile that is formed using elastic material that can stretched. Alternatively, the elastic band can be a sheeting that is formed from latex, spandex, or an elastic plastic film that can be stretched.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Elastic Yarn: As used in this disclosure, an elastic yarn is a yarn formed from elastomeric materials.

Personal Data Device: As used in this disclosure, a personal data device is a handheld device that is used for managing personal information and communication. Examples of personal data device include, but are not limited to, cellular phones, tablets and smart phones.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, sheeting is a material, such as cloth or plastic, in the form of a thin flexible layer or layers.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Textile: As used in this disclosure, a textile is a material that is woven, knitted, braided or felted. Synonyms in common usage for this definition include fabric and cloth.

With respect to the above description, it is to be realized that the optimum dimensional relationship for the various components of the invention described above and in FIGS. 1 through 10, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A wallet comprising:

a plurality of panels and a plurality of straps;

wherein the wallet is a folding case that is adapted for use with a personal data device;

wherein the wallet is configurable such that the personal data device is accessible during use;

wherein the wallet is configurable such that the personal data device is contained within the wallet for storage;

wherein the wallet is further capable of containing and storing domestic articles;

wherein each of the plurality of panels is a plate that is made of a solid material;

wherein the solid material is flexible;

wherein each of the plurality of panels is further defined with a first surface and a second surface;

wherein each of the plurality of panels is further defined with a first edge, a second edge, a third edge, and a fourth edge;

wherein each of the plurality of panels further comprises a plurality of pockets;

wherein each of the plurality of panels further comprises a plurality of holes;

wherein each of the plurality of holes is sized to receive a strap selected from the plurality of straps;

wherein a subset of holes selected from the plurality of holes is located along the second edge;

wherein a subset of holes selected from the plurality of holes is located along the fourth edge;

wherein each strap selected from the plurality of straps is threaded through the plurality of holes in order to attach the selected panel to each of the remaining panels contained in the plurality of panels;

wherein the plurality of panels further comprises a first panel, a second panel, and a third panel;

wherein the first panel further comprises a first plurality of holes;

wherein the second panel further comprises a second plurality of holes;

wherein the third panel further comprises a third plurality of holes;

wherein the first plurality of holes further comprises a first hole, a second hole, a third hole, a fourth hole, a fifth hole, and a sixth hole;

wherein the second plurality of holes further comprises a seventh hole, an eighth hole, a ninth hole, a tenth hole, an eleventh hole, and a twelfth hole;

wherein the third plurality of holes further comprises a thirteenth hole, a fourteenth hole, a fifteenth hole, a sixteenth hole, a seventeenth hole, and an eighteenth hole;

wherein the personal data device is attached to the second panel using a rail and a bracket;

wherein the bracket is a clip that is attached to the personal data device;

wherein the rail is a raised track that is attached to the first surface of the second panel;

wherein the bracket will slip over the rail;

wherein the bracket will slide along the rail such that the position of the personal data device is adjustable relative to the plurality of panels.

2. The wallet according to claim 1 wherein the personal data device is attached to the second panel using the rail and a bracket; wherein the bracket is a clip that is attached to the personal data device; wherein the bracket may be attached to the personal data device via a spring-loaded hinge; wherein the spring-loaded hinge enables the bracket to rotate outwardly with respect to the personal data device in order to support said personal data device on a supporting surface.

3. The wallet according to claim 2 wherein each end of a strap selected from the plurality of straps is threaded through holes selected from the plurality of holes; wherein any selected end of each strap selected from the plurality of straps is attached to a remaining end of the selected strap using a seam to form a band.

4. The wallet according to claim 3 wherein the plurality of straps further comprises a first strap, a second strap, a third strap, a fourth strap, a fifth strap, and a sixth strap;

wherein the first strap is further defined with a first end and a second end;

wherein the second strap is further defined with a third end and a fourth end;

wherein the third strap is further defined with a fifth end and a sixth end;

wherein the fourth strap is further defined with a seventh end and an eighth end;

wherein the fifth strap is further defined with a ninth end and a tenth end;

wherein the sixth strap is further defined with an eleventh end and a twelfth end.

5. The wallet according to claim 4 wherein the first strap is routed through the seventh hole from the second surface of the second panel to the first surface of the second panel;

wherein the first strap is routed through the fourth hole from the first surface of the first panel through to the second surface of the first panel;

wherein the first strap is routed through the first hole from the second surface of the first panel to the first surface of the first panel;

wherein the first strap is folded over the fourth edge of the first panel;

wherein the first end and the second end of the first strap are joined with a first seam.

6. The wallet according to claim 5 wherein the second strap is routed through the eighth hole from the second surface of the second panel to the first surface of the second panel;

wherein the second strap is routed through the fifth hole from the first surface of the first panel through to the second surface of the first panel;

wherein the second strap is routed through the second hole from the second surface of the first panel to the first surface of the first panel;

wherein the second strap is folded over the fourth edge of the first panel;

wherein the third end and the fourth end of the second strap are joined with a second seam.

7. The wallet according to claim 6 wherein the third strap is routed through the ninth hole from the second surface of the second panel to the first surface of the second panel;

wherein the third strap is routed through the sixth hole from the first surface of the first panel through to the second surface of the first panel;

wherein the third strap is routed through the third hole from the second surface of the first panel to the first surface of the first panel;

wherein the third strap is folded over the fourth edge of the first panel;

wherein the fifth end and the sixth end of the third strap are joined with a third seam.

8. The wallet according to claim 7 wherein the fourth strap is routed through the tenth hole from the second surface of the second panel to the first surface of the second panel;

wherein the fourth strap is routed through the thirteenth hole from the first surface of the third panel through to the second surface of the third panel;

wherein the fourth strap is routed through the sixteenth hole from the second surface of the third panel to the first surface of the third panel;

wherein the fourth strap is folded over the fourth edge of the third panel;

wherein the seventh end and the eighth end of the fourth strap are joined with a fourth seam.

9. The wallet according to claim 8 wherein the fifth strap is routed through the eleventh hole from the second surface of the second panel to the first surface of the second panel;

wherein the fifth strap is routed through the fourteenth hole from the first surface of the third panel through to the second surface of the third panel;

wherein the fifth strap is routed through the seventeenth hole from the second surface of the third panel to the first surface of the third panel;

wherein the fifth strap is folded over the fourth edge of the third panel;

wherein the ninth end and the tenth end of fifth strap are joined with a fifth seam.

10. The wallet according to claim 9 wherein the sixth strap is routed through the twelfth hole from the second surface of the second panel to the first surface of the second panel;

wherein the sixth strap is routed through the fifteenth hole from the first surface of the third panel through to the second surface of the third panel;

wherein the sixth strap is routed through the eighteenth hole from the second surface of the third panel to the first surface of the third panel;

wherein the sixth strap is folded over the fourth edge of the third panel;

wherein the eleventh end and the twelfth end of sixth strap are joined with a sixth seam.

11. The wallet according to claim 10 wherein each of the plurality of straps is a strip of sheeting material;

wherein the first seam is a heat fused seam;

wherein the second seam is a heat fused seam;

wherein the third seam is a heat fused seam;

wherein the fourth seam is a heat fused seam;

wherein the fifth seam is a heat fused seam;

wherein the sixth seam is a heat fused seam.

12. The wallet according to claim 11 wherein the sheeting material is formed from an elastomeric material.

13. The wallet according to claim 10 wherein each of the plurality of straps is a webbing;

wherein the first seam is a sewn seam;

wherein the second seam is a sewn seam;

wherein the third seam is a sewn seam;

wherein the fourth seam is a sewn seam;

wherein the fifth seam is a sewn seam;

wherein the sixth seam is a sewn seam.

14. The wallet according to claim 13 wherein the webbing is an elastic webbing.

* * * * *